US005237297A

United States Patent [19]

Ellington et al.

[11] Patent Number: 5,237,297

[45] Date of Patent: Aug. 17, 1993

[54] TRIPPING APPARATUS FOR USE WITH AN ELECTRICAL CIRCUIT BREAKER HAVING MAGNETIC TRIPPING RESPONSIVE TO LOW OVERCURRENT

[75] Inventors: Alfred Ellington, Albemarle; Robert B. Steel, Concord; James H. Leonard, Albemarle, all of N.C.

[73] Assignee: American Circuit Breaker Corporation, Albemarle, N.C.

[21] Appl. No.: 909,515

[22] Filed: Jul. 6, 1992

[51] Int. Cl.[5] ..... H01H 75/00

[52] U.S. Cl. ..... 335/35; 335/21

[58] Field of Search ..... 335/35–45, 335/21–24

[56] References Cited

U.S. PATENT DOCUMENTS

| | | | |
|---|---|---|---|
| 3,152,232 | 10/1964 | Leonard . | |
| 3,161,747 | 12/1964 | Cole . | |
| 3,171,921 | 3/1965 | Woods . | |
| 3,200,217 | 8/1965 | Bullis, Jr. . | |
| 3,555,468 | 1/1971 | Myers . | |
| 4,085,393 | 4/1978 | Grenier . | |
| 4,260,969 | 4/1981 | Troebel et al. . | |
| 4,284,968 | 8/1981 | Denoyelle et al. . | |
| 4,481,491 | 11/1984 | Heft et al. | 335/21 |
| 4,683,451 | 7/1987 | Grunert et al. . | |
| 4,868,529 | 9/1989 | Holland | 335/42 |
| 4,929,919 | 5/1990 | Link et al. | 335/35 |
| 4,933,653 | 6/1990 | Mrenna et al. . | |
| 4,951,015 | 8/1990 | Shea et al. . | |
| 4,983,939 | 1/1991 | Shea et al. . | |

*Primary Examiner*—Lincoln Donovan

*Attorney, Agent, or Firm*—Sperry, Zoda & Kane

[57] ABSTRACT

An improved tripping mechanism for use in a circuit breaker wherein magnetic tripping is responsive to low levels of overcurrent by limiting the depth of engagement of a trip lever of a cradle with respect to the latch engagement tab of the armature. Responsiveness of the magnetic tripping is enhanced by positioning of the magnetic yoke adjacent to the bimetallic member while at the same time being movable with respect to the bimetallic member. Positioning the magnetic member independently of the position of the bimetallic member facilitates having magnetic tripping responsive to low overcurrent conditions while at the same time allowing thermal tripping by movement of the bimetallic member to be fully maintained.

24 Claims, 2 Drawing Sheets

TRIPPING APPARATUS FOR USE WITH AN ELECTRICAL CIRCUIT BREAKER HAVING MAGNETIC TRIPPING RESPONSIVE TO LOW OVERCURRENT

BACKGROUND OF THE INVENTION

1. Field Of The Invention

The present invention deals with the field of electrical circuit breakers adapted to carry normal current loads therein and including two current interrupting means. The first current interrupting means is responsive to a persistent low level overcurrent which achieves thermal tripping of the circuit breaker. The second tripping means is a magnetic tripping means which is responsive to a more instantaneous higher level of current overflow through the circuit breaker for interrupting flow therethrough. The breaker of the present invention is particularly responsive to reduce the level of overcurrents to which the magnetic tripping assembly is responsive.

2. Description Of The Prior Art

Numerous prior art devices have been designed for construction of electrical circuit breakers somewhat similar to the present design such as U.S. Pat. No. 3,152,232 patented Oct. 6, 1964 to J. Leonard on a Circuit Breaker Having Bimetal Rigidly Secured To Cradle; U.S. Pat. No. 3,161,747 patented Dec. 15, 1964 to T. Cole on an Automatic Circuit Breaker Having A Combined Latch And Contact Unit Pivoted To A Contact Carrier; U.S. Pat. No. 3,171,921 patented Mar. 2, 1965 to W. Woods on a Circuit Breaker Operating Mechanism; U.S. Pat. No. 3,200,217 patented Aug. 10, 1965 to E. Bullis, Jr. on a Circuit Breaker With Thermal And Magnetic Trip Means; U.S. Pat. No. 3,555,468 patented Jan. 12, 1971 to F. Myers on a Combined Thermal-Magnetic Trip Means For Circuit Breakers; U.S. Pat. No. 4,085,393 patented Apr. 18, 1978 to A. Grenier on a Circuit Breaker; U.S. Pat. No. 4,260,969 patented Apr. 7, 1981 to W. Troebel et al on a Low Voltage Circuit Breaker With An Electromagnetic Tripping Device; U.S. Pat. No. 4,284,968 patented Aug. 18, 1981 to S. Denoyelle et al on an Adjustable Electromagnetic Tripping Mechanism For A Circuit-Breaker; U.S. Pat. No. 4,683,451 patented Jul. 28, 1987 to K. Grunert et al on a Circuit Breaker With Trip Delay Magnetic Circuit; U.S. Pat. No. 4,868,529 patented Sep. 19, 1989 to T. Holland on a Circuit Breaker Armature Latch With Control Leg; U.S. Pat. No. 4,933,653 patented Jun. 12, 1990 to S. Mrenna et al on a Circuit Breaker With Low Current Magnetic Trip; U.S. Pat. No. 4,951,015 patented Aug. 21, 1990 to J. Shea et al on a Circuit Breaker With Moving Magnetic Core For Low Current Magnetic Trip and U.S. Pat. No. 4,983,939 patented Jan. 8, 1991 to J. Shea et al on a Circuit Breaker With Adjustable Low Magnetic Trip.

SUMMARY OF THE INVENTION

The tripping apparatus of the present invention includes a housing having a magnetic member positioned in abutment with respect to the housing. The cradle is movably secured with respect to the housing and includes a trip lever thereon. The cradle is movable between a latched position which allows electrical flow through the circuit breaker and an unlatched position preventing electrical current flow therethrough.

An armature is included in the present invention having a displaced armature section which is positioned spatially displaced from the magnetic member. The displaced armature section is movable with respect to the magnet between a first armature position and a second armature position. The displaced armature section of the armature means includes a latch engagement member and is positioned adjacent the trip lever to be selectively engageable therewith. The latch engagement member of the displaced armature is engageable with respect to the trip lever responsive to the cradle being in the latching position and the displaced armature section being in the first armature position. In a similar manner the latch engagement member of the displaced armature section is capable of being disengaged with respect to the trip lever responsive to the displaced armature section of the armature moving to the second armature position thereby allowing movement of the cradle to the unlatched position and cessation of current flow through the electric circuit breaker.

The present invention also includes a bimetallic means which may preferably be capable of cantilever movement. The bimetallic means is positioned adjacent to the magnetic member but is not directly attached thereto. The bimetallic member is electrically conductive and is in the current flow path of all current flowing through the electrical circuit breaker. The bimetallic member is electrically resistive and is responsive to a first level of electrical current overflow therethrough to increase in temperature and move from a first bimetallic position which is the steady state position to a second bimetallic position responsive to persistent thermal overcurrent. This bimetallic member is attached with respect to the armature to urge movement of the armature to the second armature position responsive to the bimetallic member moving to the second bimetallic position. This movement will occur whenever a first level of electrical overflow current is sensed to initiate thermal tripping of the trip lever. The bimetallic member and the magnet are responsive to a second higher level of electrical overflow through the bimetallic member to generate an electromagnetic field therearound of a sufficient magnitude to move the armature toward the magnet and disengage the trip lever from the latch engagement member and move the cradle to the unlatched position for cessation of electrical current flow through the electric circuit breaker. This cessation of current flow through the breaker is described as magnetic tripping of the trip lever.

In a configuration of the present invention an armature stop means is included adjacent the latch engagement member to minimize the engagement between the trip lever and the latch engagement member. With this configuration an armature restraining hook of the armature extends about the bimetallic means however it is somewhat displaced therefrom to thereby reduce the interaction between the thermal and magnetic tripping. With this configuration the magnet itself is positioned extending about the bimetallic member but the magnetic member is not attached to the bimetallic member. In this configuration the magnetic member is fixedly secured in the housing. With such a configuration the spacing between the armature and the magnet can be controlled independently of the position of the bimetallic member under normal current flow conditions.

In another configuration the magnetic member is pivotally mounted within a notch defined in the housing. The magnetic member includes a slot therein in which the armature is pivotally mounted with the displaced armature section being movable with respect to the magnetic member and having movement thereof controlled by an armature retaining means including a retaining shaft and a retaining member to again minimize engagement between the trip lever of the cradle and the latch of the armature. With this configuration the magnet will preferably define an abutment point thereon adapted to be abutted by the bimetallic member responsive to movement thereof to the second bimetallic position for achieving thermal tripping of the breaker such that the magnetic member will move and the armature will move therewith causing disengagement of the lever of the cradle from the latch of the armature. This would be effective to achieve thermal tripping of the breaker.

It is an object of the present invention to provide an improved tripping apparatus for use with an electrical circuit breaker having magnetic tripping responsive to low overcurrent conditions wherein little modification is required to be made to existing circuit breaker designs.

It is an object of the present invention to provide an improved tripping apparatus for use with an electrical circuit breaker having magnetic tripping responsive to low overcurrent conditions wherein responsiveness of magnetic tripping to low overcurrent conditions is enhanced.

It is an object of the present invention to provide an improved tripping apparatus for use with an electrical circuit breaker having magnetic tripping responsive to low overcurrent conditions wherein construction of the breaker can be performed economically.

It is an object of the present invention to provide an improved tripping apparatus for use with an electrical circuit breaker having magnetic tripping responsive to low overcurrent conditions wherein maintenance requirements of the circuit breaker is minimized.

It is an object of the present invention to provide an improved tripping apparatus for use with an electrical circuit breaker having magnetic tripping responsive to low overcurrent conditions wherein independence of operation of the magnetic and thermal tripping mechanism of an electrical circuit breaker is maximized.

It is an object of the present invention to provide an improved tripping apparatus for use with an electrical circuit breaker having magnetic tripping responsive to low overcurrent conditions wherein positioning of the magnet in spaced relationship with respect to the armature can be controlled independently of the positioning of the bimetallic member.

It is an object of the present invention to provide an improved tripping apparatus for use with an electrical circuit breaker having magnetic tripping responsive to low overcurrent conditions wherein performance characteristics are optimized without requiring substantial change in the design of the basic electrical circuit breaker.

It is an object of the present invention to provide an improved tripping apparatus for use with an electrical circuit breaker having magnetic tripping responsive to low overcurrent conditions wherein engagement between the trip lever and the latch tab are minimized to increase the sensitivity of the magnetic tripping characteristics in response to low overcurrent levels.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
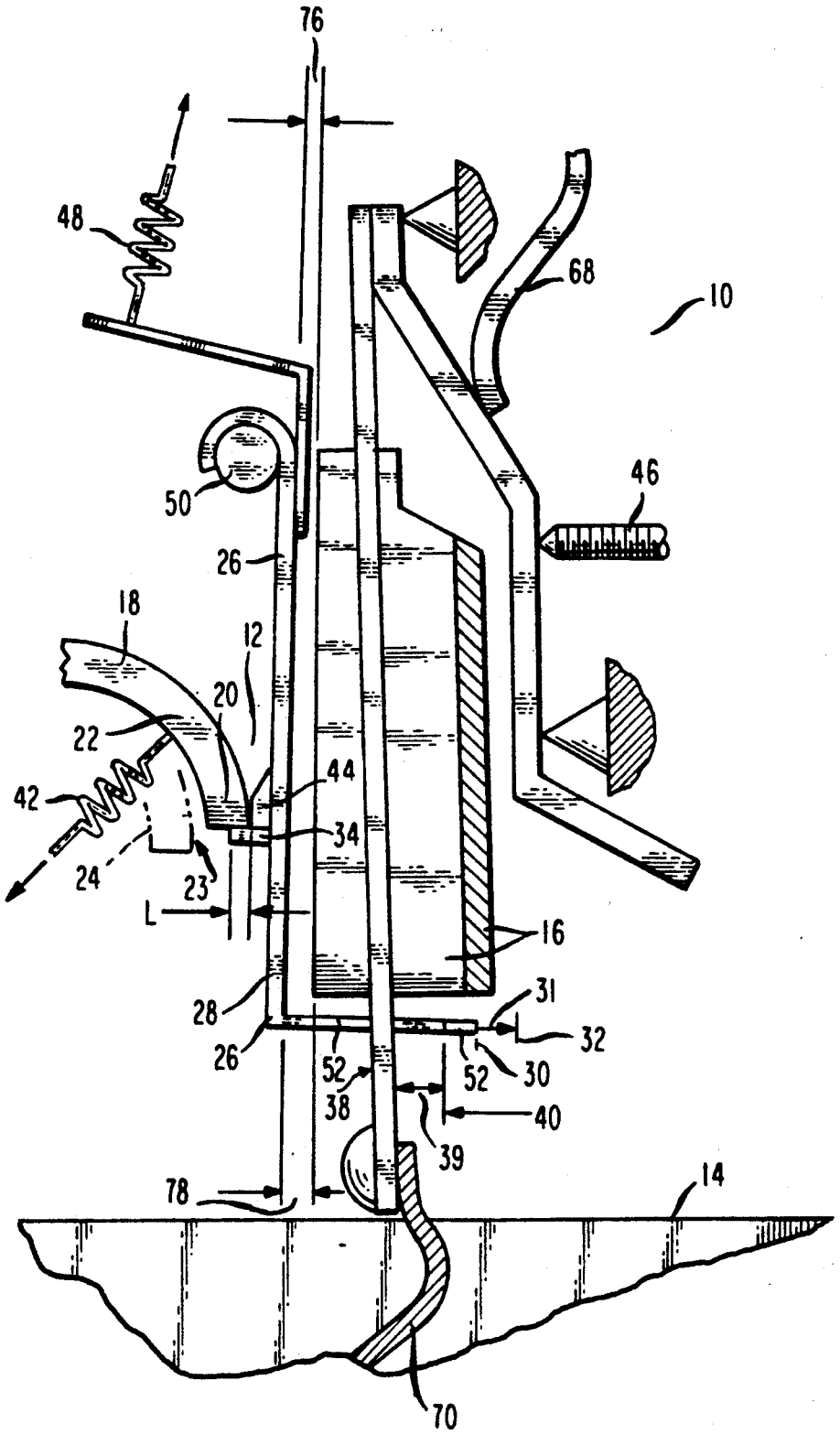
FIG. 1 is a side plan view of an embodiment of the improved apparatus of the present invention.

The present invention provides an electrical circuit breaker 10 including a tripping apparatus 12 for controlling electric current flow therethrough.

The breaker 10 includes a housing 14 having a magnetic means 16 in abutment therewith. The magnetic means 16 may be fixedly secured in the housing as in the configuration shown in FIG. 1 or may be pivotally secured within a notch defined in the housing as shown in FIG. 2. In either configuration the magnetic member 16 is in abutment with respect to the housing.

A cradle 18 is included in the improved tripping apparatus of the present invention. The cradle means 18 is of a fairly conventional configuration such that it is movable between a latched position 22 allowing current flow through the electrical circuit breaker 10 and an unlatched position 24 preventing electrical current flow through the electrical circuit breaker 10. The movement of the cradle means 18 between latched position 22 and unlatched position 24 is along the line of arrow 23 as shown best in FIG. 1.

Control of movement of the cradle means 18 is achieved by the inclusion of a trip lever means 20 positioned thereon. Trip lever means 20 is positioned adjacent an armature 26. The armature 26 preferably includes a displaced armature section 28 which is movable between a first armature position 30 and a second armature position 32 along the direction shown by arrow 31. A latch engagement member 34 is positioned to be engageable with said trip lever 20 during normal current flow conditions.

Figure 2:
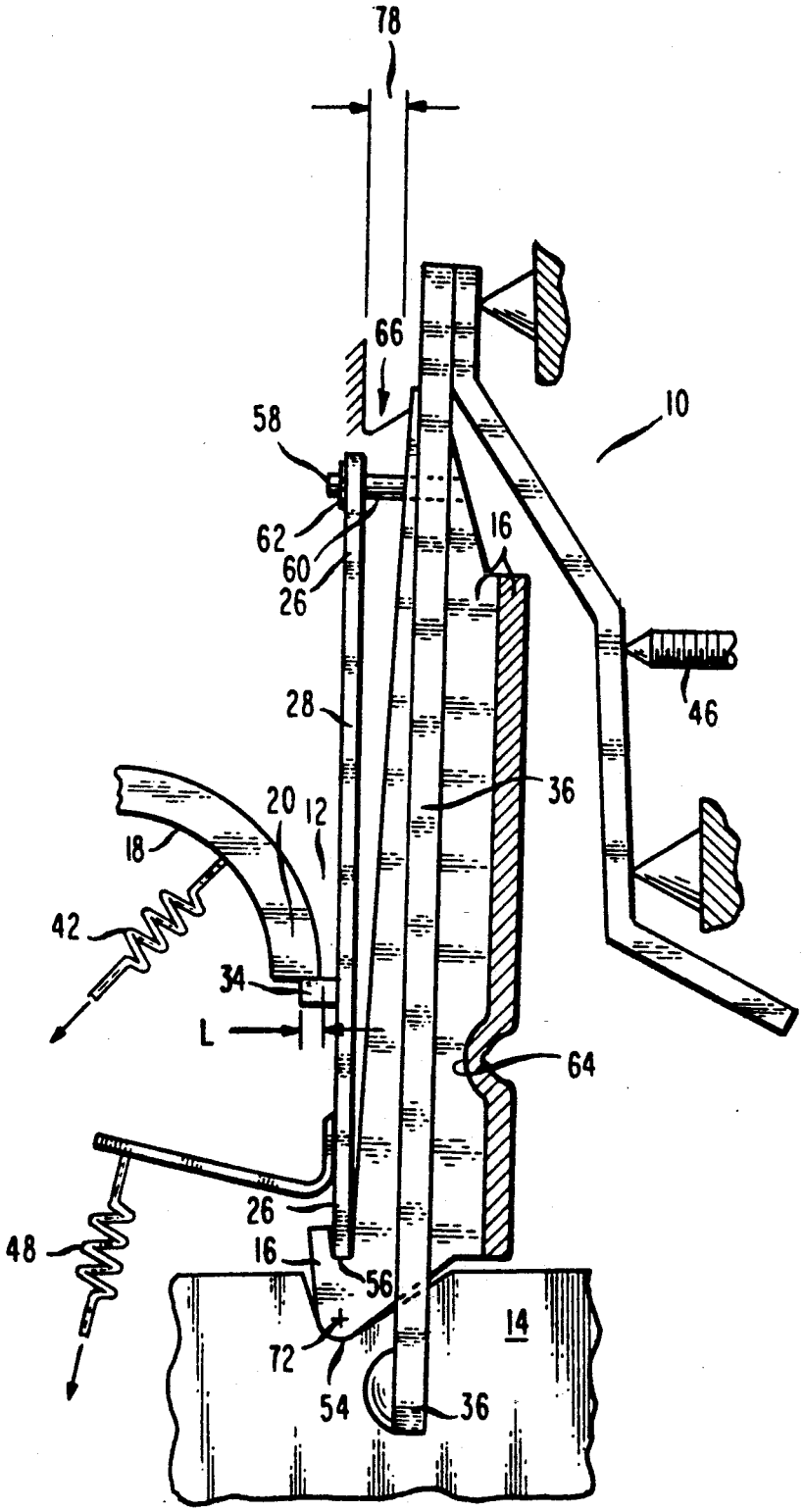
FIG. 2 is a side plan view of an alternative embodiment of the tripping apparatus of the present invention.

A bimetallic member 36 is movable between a first bimetallic position 38 and a second bimetallic position 40 along the direction of arrow 39 as shown best in FIG. 1. The bimetallic means 36 is adapted to be positioned in the first bimetallic position 38 responsive to normal current flow conditions and being adapted to move along the line shown by arrow 39 to the second bimetallic position 40 responsive to a persistent first level of current overflow.

The present invention may also include a trip lever biasing means 42 adapted to urge the cradle means 18 to the unlatched position 24.

An armature stop means 44 may be included which is best shown in FIG. 1 and is adapted to minimize the depth of engagement between the trip lever 20 of cradle 18 and the latch engagement member 34 of armature 26. Furthermore a thermal adjustment means such as a screw means 46 may be positioned adjacent the bimetallic means 36 to control sensitivity thereof responsive to a persistent first level of overflow current.

The armature 26 within the configuration shown in FIG. 1 includes an armature biasing means 48 adapted to urge the armature into the position of engagement of the latch engagement member 34 thereof with respect to the trip lever 20 of the cradle 18. The armature 26 with this configuration is preferably mounted upon a mounting pin 50. Within this configuration shown in FIG. 1 an armature restraining hook 52 is included extending hooking about the bimetallic means 36 to be responsive to movement of the bimetallic member for initiating thermal tripping responsive to movement of the lower end of the bimetallic member to the right as shown in FIG. 1 resulting in engagement of the armature restraining hook 52 with respect to the bimetallic means 36 and a resulting disengagement of the latch engagement member 34 from the trip lever 20 to achieve thermal tripping of the breaker 10. In the configuration shown in FIG. 2 a notch means 54 is defined in the housing 14 into which the magnetic member 16 is pivotally positioned. The magnetic member 16 itself also defines a slot means 56 therein adapted to receive the armature 26 mounted therein. The displaced armature section 28 which in the FIG. 2 configuration is the upper portion thereof is adapted to be movable toward and away from the magnetic member 16 responsive to conditions sensed by the breaker 10. Particularly, in response to a second level of more instantaneous electrical overcurrent through the bimetallic member 36 the displaced armature section 28 will be adapted to move toward the second armature position 32 along the line of arrow 31 resulting in disengagement of the latch engagement member 34 from the trip lever 20 thereby achieving magnetic tripping of the circuit breaker 10. The responsiveness of magnetic tripping is enhanced by an armature retaining means 58 being included within the configuration shown in FIG. 2. This armature retaining means 58 is adapted to limit the depth, "L", of engagement between the trip lever 20 and the latch engagement member 34. The depth of engagement of the latch engagement member 34 with respect to the trip lever 20 is achieved by the retaining shaft 60 of the armature retaining device 58 extending through the armature 26 with the retaining member 62 positioned to the left thereof as shown in FIG. 2. In this manner sensitivity of the magnetic tripping of the apparatus of the present invention is significantly enhanced without significantly altering the thermal tripping characteristics. The retaining shaft could comprise merely any type of non-magnetic link or appendage coupling the armature and magnet to reliably establish the desired de-energized air gap.

In the FIG. 2 configuration thermal tripping is achieved by movement of the bimetallic member 36 to the right adjacent the abutment point means 64. Contact between the bimetallic member 36 and the abutment point 64 results in urging of the magnetic means 16 to the right and disengagement of the latch engagement member 34 from the trip lever 20. This describes the thermal tripping characteristics of the configuration of FIG. 2. The electrical flow through the circuit breaker 10 is passed preferably into the first flexible member 68 through the bimetallic member 36 in the portion thereof adjacent the magnet 16 and will exit therefrom through the second flexible connector 70 downstream of the positioning of the magnetic member.

In both configurations the spacing 76 and 78 or gap between the magnetic member 16 and the armature 26 is significant in determining the electromagnetic field to which the armature 26 is exposed responsive to the more instantaneous second level of current overflow wherein magnetic tripping is desired. Responsiveness of this magnetic tripping is achieved by minimizing of these gaps 76 and 78. Although the gaps should be minimized if at all possible they certainly do have to be large enough in order to effect actual disengagement of the latch engagement member 34 from the trip lever 20. With the present invention for the first time spacing of these gaps can be controlled independently of the positioning of the bimetallic member 36 due to decoupling of the magnetic means 18 from the bimetallic member 36.

The configuration shown in FIG. 1 is chosen in order to minimize structural changes over existing circuit breaker designs while achieving the improved magnetic tripping characteristics of the present invention. With this configuration the latch engagement distance, "L", is minimized. Distance "L" is established by the armature stop 44 positioned immediately adjacent the latch engagement member 34. With this configuration the gaps 76 and 78 can be established independently of positioning of the bimetallic member 36. Also interaction between the magnetic tripping and thermal tripping is minimized by allowing an amount of spacing shown by arrow 39 between the normal current position of the bimetallic member or first bimetallic position from the location of the armature restraining hook means 52.

With the configuration of FIG. 1 if the circuit breaker is exposed to a first level of persistent current overflow the bimetallic member will move from the first bimetallic position 38 to the second bimetallic position shown at line 40. At this point bimetallic member 36 will contact the armature restraining hook 52 and urge movement of the armature rotationally in a counterclockwise direction about the mounting pin 50. Only a slight amount of such movement after contact between the bimetallic member and the armature restraining hook 52 will cause disengagement between latch engagement member 34 and the trip lever 20 of cradle 18 thereby achieving thermal tripping of the apparatus shown in FIG. 1.

Magnetic tripping of the mechanism shown in FIG. 1 will be achieved in response to a second higher level of more instantaneous current overflow conditions responsive to such current overflow conditions through bimetallic member 36 and will cause an electromagnetic field to be generated about the bimetallic member. This electrical field will be amplified by the magnetic means 16 extending about the bimetallic member 36. This electromagnetic field will attract the armature 26 causing counterclockwise rotation thereof about mounting pin 50 and disengagement of latch engagement member 34 from trip lever 20 resulting in magnetic tripping of the breaker 10 of the present invention.

The configuration shown in FIG. 2 is designed to maximize the effectiveness of operation of the principles of the present invention without regard to maintaining aspects of the pre-existing configurations currently available. This configuration is designed to optimize performance while requiring substantial change from currently utilized designs. As can be seen in the FIG. 2 configuration, the armature biasing means 48 and the trip lever 20 are both urged to move in approximately the same direction. The lower gap 76 becomes zero since the armature 26 is pivotally mounted within the slot 56 defined in the magnet 16. With this configuration the magnet 16 is pivotally mounted within a notch 54 defined within the housing 14. As such, the magnet as well as the armature rotate about a pivot center 72. A fixed magnetic stop 66 limits the counterclockwise movement of the magnet 16 about the pivot center 72. With this configuration latch engagement gap, "L", is fixed and minimized. Also this engagement distance and the gap 78 are independent of the position of the bimetallic member 36 during normal current flow conditions. Positioning of the bimetallic member 36 can be modified or calibrated by positioning of the thermal adjustment screw 46. The reaction points or abutment point 64 also can be chosen at any point along the armature to optimize characteristics of motion amplification between movement of the bimetallic member 36 and the armature 64.

Responsive to a first level of persistent current overflow the bimetallic member shown in FIG. 2 will move to the right until contact with the abutment or reaction point 64 is achieved. Thereafter movement of the bimetallic member 36 to the right will cause movement of the magnetic member 16 only slightly in a clockwise direction pivoting about pivot center 72. With this configuration as shown in FIG. 2 such pivotal movement of the magnetic means will cause similar movement to the right of the armature 26 resulting in disengagement of the latch engagement means 34 from the trip lever 20 and thermal tripping of the circuit breaker 10.

With the configuration shown in FIG. 2 magnetic tripping will be responsive to a second level of current overflow which is more instantaneous than the first level of current flow and need not be as persistent. The second level of current overflow will cause an electromagnetic field to be generated around the bimetallic member 36 responsive to current flow therethrough. This electromagnetic field will be enhanced by the magnetic means 16 thereby attracting the armature 26 to move to the right as shown in FIG. 2 resulting in disengagement of the latch engagement member 34 from the trip lever 20 to effect magnetic tripping of the apparatus shown in FIG. 2. This magnetic tripping will be more responsive due to the limitations imposed on engagement of the latch engagement member 34 with the trip lever 20 to only the small spacing "L" as a result of the armature retaining means 58 resulting from the retaining shaft 60 extending through the armature 26 and the retaining member 62 positioned on the outermost end thereof. This restraining of the engagement between the members 34 and 20 will greatly increase the sensitivity of magnetic tripping in response to lower levels of instantaneous overcurrent.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. An improved tripping apparatus for use with a electrical circuit breaker having magnetic tripping responsive to low overcurrent conditions comprising:

A. a housing means;

B. a magnetic means positioned in abutting contact with said housing means;

C. a cradle means movably secured with respect to said housing means and including a trip lever means, said cradle means being moveable between a latched position allowing electrical flow through the electrical circuit breaker and an unlatched position preventing electrical current flow through the electrical circuit breaker;

D. an armature means including a displaced armature section which is positioned spatially displaced from said magnetic means, said displaced armature section being moveable with respect to said magnetic means between a first armature position and a second armature position, said displaced armature section of said armature means including a latch engagement member being positioned adjacent said trip lever means of said cradle means and being selectively engageable therewith, said latch engagement member of said displaced armature section being engageable with respect to said trip lever means responsive to said cradle means being in the latching position and said displaced armature section being in the first armature position, said latch engagement member of said displaced armature section being disengageable with respect to said trip lever means responsive to said displaced armature section of said armature means moving to the second armature position to allow movement of said cradle means to the unlatched position preventing electrical current flow through the electrical circuit breaker; and E. a bimetallic means positioned adjacent said magnetic means and being moveable with respect thereto, said bimetallic means being electrically conductive and adapted to receive therethrough electrical current flow passing through the electrical circuit breaker, said bimetallic means being electrically resistive and being responsive to a first level of electrical current overflow therethrough to increase in temperature and move from a first bimetallic position of steady state to a second bimetallic position of thermally activated overcurrent, said bimetallic means being attached with respect to said armature means to urge movement thereof to the second armature position responsive to said bimetallic means moving to the second bimetallic position responsive to a first level of electrical current overflow therethrough for thermally activated tripping of said trip lever means, said bimetallic means and said magnetic means being responsive to a second level of electrical overflow through said bimetallic means to generate an electromagnetic field therearound sufficient to urge movement of said armature means toward said magnetic means and facilitate disengagement of said trip lever means with respect to said latch engagement member and facilitate movement of said cradle means to the unlatched position for interrupting electrical current flow through the electrical circuit breaker and effecting magnetically activated tripping of said trip lever means, said second level of electrical overflow through said bimetallic means being greater than said first level of electrical overflow therethrough.

2. An improved tripping apparatus for use with a electrical circuit breaker having magnetic tripping responsive to low overcurrent conditions as defined in claim 1 wherein said trip lever means of said cradle means is biased into engagement with respect to said latch engagement member.

3. An improved tripping apparatus for use with a electrical circuit breaker having magnetic tripping responsive to low overcurrent conditions as defined in claim 1 wherein said armature means includes an armature stop means positioned adjacent said latch engagement member to limit the depth of engagement of said trip lever means with respect to said latch engagement member.

4. An improved tripping apparatus for use with a electrical circuit breaker having magnetic tripping responsive to low overcurrent conditions as defined in claim 1 wherein said magnetic means is positioned extending around said bimetallic means to enhance electromagnetic attraction thereof with respect to said armature means responsive to a second level of electrical current overflow through said bimetallic means.

5. An improved tripping apparatus for use with a electrical circuit breaker having magnetic tripping responsive to low overcurrent conditions as defined in claim 1 wherein the second armature position of said armature means is located closer to said magnetic means and said bimetallic means than the position of the first armature position.

6. An improved tripping apparatus for use with a electrical circuit breaker having magnetic tripping responsive to low overcurrent conditions as defined in claim 1 further comprising a thermal adjustment means in abutment with respect to said bimetallic means to control positioning thereof and thermal tripping of the improved tripping apparatus independently of said magnetic means.

7. An improved tripping apparatus for use with a electrical circuit breaker having magnetic tripping responsive to low overcurrent conditions as defined in claim 6 wherein said thermal adjustment means comprises a thermal adjustment screw.

8. An improved tripping apparatus for use with a electrical circuit breaker having magnetic tripping responsive to low overcurrent conditions as defined in claim 1 wherein said magnetic means is fixedly secured with respect to said housing means.

9. An improved tripping apparatus for use with a electrical circuit breaker having magnetic tripping responsive to low overcurrent conditions as defined in claim 1 further including an armature biasing means in operative engagement with respect to said armature means for biasing of said latch engagement member of said displaced armature section into latching engagement with respect to said trip lever means of said cradle means.

10. An improved tripping apparatus for use with a electrical circuit breaker having magnetic tripping responsive to low overcurrent conditions as defined in claim 1 wherein said armature means and said displaced armature section thereof are pivotally mounted with respect to said housing means.

11. An improved tripping apparatus for use with a electrical circuit breaker having magnetic tripping responsive to low overcurrent conditions as defined in claim 10 wherein said housing means further comprises a mounting pin with said armature means and said displaced armature section thereof pivotally mounted thereon.

12. An improved tripping apparatus for use with a electrical circuit breaker having magnetic tripping responsive to low overcurrent conditions as defined in claim 1 wherein said armature means includes an armature restraining hook means positioned adjacent said bimetallic means and engageable with respect to said bimetallic means responsive to movement thereof from the first bimetallic position to the second bimetallic position to urge movement of said armature means from the first armature position to the second armature position.

13. An improved tripping apparatus for use with a electrical circuit breaker having magnetic tripping responsive to low overcurrent conditions as defined in claim 12 wherein said armature restraining hook means is adjacent said bimetallic means and spatially disposed therefrom to minimize interaction between thermal tripping and magnetic tripping of said trip lever means of said cradle means.

14. An improved tripping apparatus for use with a electrical circuit breaker having magnetic tripping responsive to low overcurrent conditions as defined in claim 1 wherein spatial displacement of said armature means from said magnetic means is independent of variations in positioning of said bimetallic means during electrical current flow conditions less than the first level of electrical current overflow.

15. An improved tripping apparatus for use with a electrical circuit breaker having magnetic tripping responsive to low overcurrent conditions as defined in claim 1 wherein said housing means defines a notch means therein and wherein said magnetic means is pivotally mounted therein to facilitate pivotal movement of said magnetic means with respect to said housing means.

16. An improved tripping apparatus for use with a electrical circuit breaker having magnetic tripping responsive to low overcurrent conditions as defined in claim 15 wherein said magnetic means defines a slot means therein and wherein said armature means is pivotally mounted within said slot means to facilitate pivotal movement of said displaced armature section from the first armature position to the second armature position.

17. An improved tripping apparatus for use with a electrical circuit breaker having magnetic tripping responsive to low overcurrent conditions as defined in claim 1 further including an armature retaining means to limit the depth of engagement of said trip lever means with respect to said latch engagement member.

18. An improved tripping apparatus for use with a electrical circuit breaker having magnetic tripping responsive to low overcurrent conditions as defined in claim 17 wherein said armature retaining means includes a retaining shaft secured with respect to said magnetic means and extending through said displaced armature section.

19. An improved tripping apparatus for use with a electrical circuit breaker having magnetic tripping responsive to low overcurrent conditions as defined in claim 18 wherein said armature retaining means includes a retaining member secured with respect to said retaining shaft to limit the depth of engagement of said trip lever means with respect to said latch engagement member.

20. An improved tripping apparatus for use with a electrical circuit breaker having magnetic tripping responsive to low overcurrent conditions as defined in claim 16 wherein said magnetic means includes an abutment point means thereon adapted to be contacted by said bimetallic means responsive to movement thereof from the first bimetallic position to the second bimetallic position and urge said magnetic means to pivot within said notch means and urge movement of said moveable armature means positioned in said slot means to facilitate disengagement of said latch engagement member with respect to said trip lever means to achieve thermal tripping of said trip lever means responsive to a first level of electrical current overflow through said bimetallic means.

21. An improved tripping apparatus for use with a electrical circuit breaker having magnetic tripping responsive to low overcurrent conditions as defined in claim 1 wherein said armature means is in abutment with respect to said magnetic means within said slot means thereof.

22. An improved tripping apparatus for use with a electrical circuit breaker having magnetic tripping responsive to low overcurrent conditions as defined in claim 16 further comprising a magnetic stop means positioned adjacent said magnetic means and spatially disposed form said notch means in said housing means to limit pivotal movement of said magnetic means within said notch means toward said trip lever means.

23. An improved tripping apparatus for use with a electrical circuit breaker having magnetic tripping responsive to low overcurrent conditions comprising:

A. a housing means including a mounting pin therein;

B. a magnetic means fixedly secured to be immovably engaged to said housing means;

C. a cradle means movably secured with respect to said housing means and including a trip lever means, said cradle means being moveable between a latch position allowing electrical flow through the electrical circuit breaker and an unlatched position preventing electrical current flow through the electrical circuit breaker;

D. an armature means including a displaced armature section therein which is pivotally movably mounted upon said mounting pin of said housing means and positioned spatially disposed form said magnetic means, said disposed armature section being moveable with respect to said magnetic means between a first armature position and a second armature position with the second armature position being located closer to said magnetic means than the first armature position, said displaced armature section of said armature means including a latch engagement member extending outwardly therefrom, said latch engagement member being positioned adjacent said trip lever means of said cradle means and being selectively engageable therewith, said armature means including an armature stop means positioned adjacent said latch engagement member to limit the depth of engagement of said trip lever means with respect to said latch engagement member, said trip lever means of said cradle means being biased into engagement with respect to latch engagement member, said latch engagement member of said displaced armature section being engageable with respect to said trip lever means responsive to said cradle means being in the latching position and said displaced armature section being in the first armature position, said latch engagement member of said displaced armature section being disengageable with respect to said trip lever means responsive to said displaced armature section of said armature means moving to the second armature position to allow movement of said cradle means to the unlatched position preventing electrical current flow through the electrical circuit breaker, said armature means including an armature restraining hook means;

E. a bimetallic means positioned with said magnetic means being there adjacent and extending therearound, said bimetallic means being moveable with respect to said magnetic means, said bimetallic means being electrically conductive and adapted to receive therethrough the electrical current flow passing through the electrical circuit breaker, said bimetallic means being electrically resistive and being responsive to a first level of electrical current overflow therethrough to increase in temperature and move from a first bimetallic position to a second bimetallic position to achieve thermally activated tripping of said trip lever means, said bimetallic means being attached with respect to said armature means to urge movement thereof to the second armature position responsive to said bimetallic means moving to the second bimetallic position responsive to a first level of electrical current overflow therethrough to achieve thermally activated tripping of said trip lever means, said bimetallic means and said magnetic means being responsive to a second level of electrical overflow through said bimetallic means to generate an electromagnetic field therearound sufficient to urge movement of said armature means toward said magnetic means and facilitate disengagement of said trip lever means with respect to said latch engagement member and facilitate movement of said cradle means to the unlatched position for interrupting electrical current flow through the electrical circuit breaker and achieving magnetically activated tripping of said trip lever means, the second level of electrical overflow through said bimetallic means being greater than said first level of electrical overflow therethrough, said armature restraining hook means being engageable with respect to said bimetallic means responsive to movement thereof from the first bimetallic position to the second bimetallic position to urge movement of said armature means from the first armature position to the second armature position to facilitate release or engagement between said trip lever means and said latch engagement member, said bimetallic means being spatially disposed with respect to said restraining hook means to minimize interaction between thermal tripping and magnetic tripping of the improved tripping apparatus;

F. a thermal adjustment screw means in abutment with respect to said bimetallic means to control positioning thereof independently of relative positioning of said magnetic means with respect to said armature means; and G. an armature biasing means in operative engagement with respect to said armature means for biasing of said latch engagement member of said displaced armature section into latching engagement with respect to said trip lever means of said cradle means.

24. An improved tripping apparatus for use with a electrical circuit breaker having magnetic tripping responsive to low overcurrent conditions A. a housing means defining a notch means therein;

B. a magnetic means positioned extending into said notch means defined in said housing means to be pivotally moveable with respect thereto, said magnetic means defining a slot means therein, said magnetic means further including an abutment point means positioned thereon;

C. a cradle means movably secured with respect to said housing means and including a trip lever means, said cradle means being moveable between a latched position allowing electrical flow through the electrical circuit breaker and an unlatched position preventing electrical current flow through the electrical circuit breaker;

D. an armature means including a displaced armature section therein which is positioned spatially disposed form said magnetic means, said armature means being pivotally movably mounted in said slot means defined in said magnetic means to be in abutment with respect thereto, said displaced armature section being pivotally moveable with respect to said magnetic means between a first armature position and a second armature position, said displaced armature section of said armature means including a latch engagement member extending outwardly therefrom, said latch engagement member being positioned adjacent said trip lever means of said cradle means and being selectively engageable therewith, said latch engagement member of said displaced armature section being engageable with respect to said trip lever means responsive to said cradle means being in the latching position and said displaced armature section being in the first armature position, said latch engagement member of said displaced armature section being disengageable with respect to said trip lever means responsive to said displaced armature section of said armature means moving to the second armature position to allow movement of said cradle means to the unlatched position preventing electrical current flow through the electrical circuit breaker, the second armature position of said armature means being located closer to said magnetic means and said bimetallic means than the position of the first armature section, said armature means including an armature retaining means adapted to establish a spacing between said armature means and said magnetic means and adapted to limit the depth of engagement of said trip lever means with respect to said latch engagement member, said armature retaining means comprising:

(1) a retaining shaft secured with respect to said magnetic means and extending through said displaced armature section;

(2) a retaining member secured with respect to said retaining shaft to limit the depth of engagement of said trip lever means with respect to said latch engagement member;

E. a bimetallic means positioned adjacent said magnetic means and adjacent said abutment point means located thereon and being moveable with respect thereto, said bimetallic means being electrically conductive and adapted to receive therethrough the electrical current flow passing through the electrical circuit breaker, said bimetallic means being electrically resistive and being responsive to a first level of electrical current overflow therethrough to increase in temperature and move from a first bimetallic position to a second bimetallic position to achieve thermally activated tripping of said trip lever means, said bimetallic means being attached with respect to said armature means to urge movement thereof to the second armature position responsive to said bimetallic means moving to the second bimetallic position responsive to a first level of electrical current overflow therethrough to achieve thermally activated tripping of said trip lever means, attachment of said bimetallic means with respect to said armature means including abutment of said bimetallic means with respect to said abutment point means of said magnetic means responsive to movement of said bimetallic means from the first bimetallic position to the second bimetallic position urging movement of said displaced armature section away from said trip lever means and disengagement of said latch engagement member from said trip lever means responsive to the first level of electrical current overflow through said bimetallic means to achieve thermally activated tripping of said trip lever means, said bimetallic means and said magnetic means being responsive to a second level of electrical overflow through said bimetallic means to generate an electromagnetic field therearound sufficient to urge movement of said armature means toward said magnetic means and facilitate disengagement of said trip lever means with respect to said latch engagement member and facilitate movement of said cradle means to the unlatched position preventing electrical current flow through the electrical circuit breaker to achieve magnetically activated tripping of said trip lever means, said magnetic means being positioned extending about said bimetallic means to enhance an electromagnetic field generated therearound responsive to a second level of electrical overflow therethrough and facilitate achieving of magnetically activated tripping of said trip lever means, said second level of electrical current overflow through said bimetallic means being greater than said first level of electrical current overflow therethrough;

F. a trip lever biasing means adapted to bias said trip lever means into engagement with respect to said latch engagement member;

G. a thermal adjustment screw means positioned in abutment with respect to said bimetallic means to control positioning thereof and thermal tripping sensitivity of said trip lever means; and H. a magnetic stop means positioned adjacent said magnetic means and spatially disposed from said notch means in said housing means to limit pivotal movement of said magnetic means within said notch means toward said trip lever means.

* * * * *

UNITED STATES PATENT AND TRADEMARK OFFICE

CERTIFICATE OF CORRECTION

PATENT NO. :5,237,297

DATED :August 17, 1993

INVENTOR(S) :Alfred Ellington, Robert B. Steel, James H. Leonard

It is certified that error appears in the above-indentified patent and that said Letters Patent is hereby corrected as shown below:

In column 11, line 4, change "1" to --16--.
In column 11, line 12, change "form" to --from--.
In column 11, line 31, change "form" to --from--.
In column 11, line 32, change "disposed" to --displaced--.
In column 12, line 37, change "or" to --of--.
In column 12, line 55, after "conditions" insert --comprising--.

Signed and Sealed this

Twenty-first Day of June, 1994

*Attest:*

Bruce Lehman

BRUCE LEHMAN

*Attesting Officer*

*Commissioner of Patents and Trademarks*